US011359454B2

(12) United States Patent
Helms et al.

(10) Patent No.: US 11,359,454 B2
(45) **Date of Patent: *Jun. 14, 2022**

(54) BUOYANCY ASSIST TOOL WITH ANNULAR CAVITY AND PISTON

(71) Applicant: Halliburton Energy Services, Inc., Houston, TX (US)

(72) Inventors: Lonnie Carl Helms, Humble, TX (US); Frank Vinicio Acosta, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 133 days.

This patent is subject to a terminal disclaimer.

(21) Appl. No.: 16/890,168

(22) Filed: Jun. 2, 2020

(65) Prior Publication Data

US 2021/0372223 A1 Dec. 2, 2021

(51) Int. Cl.
*E21B 33/12* (2006.01)
*E21B 34/06* (2006.01)

(52) U.S. Cl.
CPC ..... *E21B 33/12* (2013.01); *E21B 34/063* (2013.01); *E21B 2200/08* (2020.05)

(58) Field of Classification Search
CPC ..... E21B 33/12; E21B 34/063; E21B 2200/08
See application file for complete search history.

(56) References Cited

U.S. PATENT DOCUMENTS 3,463,351 A 8/1969 Mills
3,779,263 A * 12/1973 Edwards ..... E21B 34/063 137/68.25
3,980,134 A 9/1976 Amancharla
4,457,376 A 7/1984 Carmody et al.
5,150,756 A 9/1992 Hassanzadeh
5,479,986 A 1/1996 Gano et al.
5,765,641 A * 6/1998 Shy ..... E21B 23/00 166/292
5,826,661 A 10/1998 Parker et al.
6,026,903 A 2/2000 Shy et al.
6,076,600 A 6/2000 Vick, Jr. et al.
(Continued)

FOREIGN PATENT DOCUMENTS

EP 0566290 A1 10/1993
EP 0681087 B1 9/2000
(Continued)

OTHER PUBLICATIONS

International Search Report and Written Opinion dated Jul. 21, 2020, issued in PCT Application No. PCT/US2019/059864.
(Continued)

*Primary Examiner* — Steven A MacDonald
(74) *Attorney, Agent, or Firm* — McAfee & Taft

(57) ABSTRACT

A downhole apparatus comprises a casing string with a degradable plug therein to block flow therethrough. A flow barrier is positioned in the casing below the degradable plug and the degradable plug and the flow barrier defining a buoyancy chamber therebetween. An annular fluid reservoir holds a degrading fluid. The fluid reservoir has first and second rupture disks at upper and lower ends. Fluid from the annular fluid reservoir is communicated to the degradable plug after the first and second rupture disks rupture.

20 Claims, 4 Drawing Sheets

(56) References Cited

U.S. PATENT DOCUMENTS

| | | | | |
|---|---|---|---|---|
| 6,161,622 | A | 12/2000 | Robb et al. | |
| 6,324,904 | B1 | 12/2001 | Ishikawa et al. | |
| 6,450,263 | B1 | 9/2002 | Schwendemann | |
| 6,505,685 | B1 | 1/2003 | Sullaway et al. | |
| 6,622,798 | B1 | 9/2003 | Rogers et al. | |
| 6,651,748 | B2 | 11/2003 | Sullaway et al. | |
| 6,672,389 | B1 | 1/2004 | Hinrichs | |
| 6,758,281 | B2 | 7/2004 | Sullaway et al. | |
| 7,270,191 | B2 | 9/2007 | Drummond et al. | |
| 8,505,621 | B2 | 8/2013 | Telfer et al. | |
| 9,033,055 | B2 | 5/2015 | Mccoy et al. | |
| 9,309,752 | B2 | 4/2016 | Talley et al. | |
| 9,441,437 | B2 | 9/2016 | Fripp et al. | |
| 9,441,446 | B2 | 9/2016 | Fripp et al. | |
| 9,518,445 | B2 | 12/2016 | Noske | |
| 9,540,904 | B2 | 1/2017 | Petrowsky | |
| 9,593,542 | B2 | 3/2017 | Getzlaf et al. | |
| 9,822,619 | B2 * | 11/2017 | Holderman | E21B 43/08 |
| 10,138,707 | B2 | 11/2018 | Tolman et al. | |
| 10,323,478 | B2 | 6/2019 | Berscheidt et al. | |
| 11,142,994 | B2 * | 10/2021 | Yuan | E21B 34/063 |
| 2002/0185273 | A1 | 12/2002 | Aronstam et al. | |
| 2003/0116324 | A1 | 6/2003 | Dawson et al. | |
| 2003/0217844 | A1 | 11/2003 | Moyes | |
| 2008/0073075 | A1 * | 3/2008 | Buyers | E21B 33/1208 166/188 |
| 2008/0115942 | A1 | 5/2008 | Keller et al. | |
| 2010/0270031 | A1 * | 10/2010 | Patel | E21B 33/1208 166/376 |
| 2010/0294376 | A1 | 11/2010 | O'Brien et al. | |
| 2011/0042099 | A1 | 2/2011 | Williamson, Jr. et al. | |
| 2011/0253392 | A1 | 10/2011 | May et al. | |
| 2012/0111566 | A1 | 5/2012 | Sherman et al. | |
| 2014/0174757 | A1 | 6/2014 | Fripp et al. | |
| 2014/0216756 | A1 | 8/2014 | Getzlaf et al. | |
| 2014/0224505 | A1 | 8/2014 | Ramon | |
| 2014/0338923 | A1 | 11/2014 | Fripp et al. | |
| 2015/0107843 | A1 | 4/2015 | Talley et al. | |
| 2015/0129205 | A1 | 5/2015 | Hofman et al. | |
| 2015/0240596 | A1 | 8/2015 | Horwell | |
| 2016/0177668 | A1 | 6/2016 | Watson et al. | |
| 2016/0333658 | A1 | 11/2016 | Keshishian et al. | |
| 2017/0096875 | A1 | 4/2017 | Ravensbergen et al. | |
| 2017/0138153 | A1 | 5/2017 | Getzlaf et al. | |
| 2018/0003004 | A1 | 1/2018 | Norman et al. | |
| 2018/0058179 | A1 | 3/2018 | Nuryaningsih et al. | |
| 2018/0080308 | A1 * | 3/2018 | Dedman | E21B 43/10 |
| 2018/0219200 | A1 | 8/2018 | Albukrek et al. | |
| 2018/0262127 | A1 | 9/2018 | Gooneratne et al. | |
| 2018/0371869 | A1 | 12/2018 | Kellner et al. | |
| 2019/0128081 | A1 | 5/2019 | Ross et al. | |
| 2019/0352994 | A1 | 11/2019 | Giroux | |
| 2019/0352995 | A1 | 11/2019 | Giroux et al. | |
| 2021/0062598 | A1 * | 3/2021 | Yuan | E21B 34/063 |
| 2021/0254430 | A1 * | 8/2021 | Yuan | E21B 34/063 |

FOREIGN PATENT DOCUMENTS

| | | | |
|---|---|---|---|
| JP | 6551001 | B2 | 7/2019 |
| WO | 2014098903 | A1 | 6/2014 |
| WO | 2015073001 | A1 | 5/2015 |
| WO | 2016176643 | A1 | 11/2016 |
| WO | 2019099046 | A1 | 5/2019 |

OTHER PUBLICATIONS

International Search Report and Written Opinion dated Jul. 23, 2020, issued in PCT Application No. PCT/US2019/061714.
International Search Report and Written Opinion dated Aug. 11, 2020, issued in PCT Application No. PCT/US2019/065862.
International Search Report and Written Opinion dated Aug. 31, 2020, issued in PCT Application No. PCT/US2020/012307.
International Search Report and Written Opinion dated Oct. 27, 2020, issued in PCT Application No. PCT/US2020/039399.
International Search Report and Written Opinion dated Feb. 24, 2021, issued in PCT Application No. PCT/US2020/040157.
International Search Report and Written Opinion dated Aug. 14, 2018, issued in PCT Application No. PCT/US2017/062528.
International Search Report and Written Opinion dated Sep. 19, 2019, issued in PCT Application No. PCT/US2018/066889.
International Search Report and Written Opinion dated Sep. 19, 2019, issued in PCT Application No. PCT/US2018/067161.
International Search Report and Written Opinion dated Aug. 23, 2019, issued in PCT Application No. PCT/US2018/064085.
International Search Report and Written Opinion dated Aug. 14, 2019, issued in PCT Application No. PCT/US2018/064051.
International Search Report and Written Opinion dated Jan. 14, 2020, issued in PCT Application No. PCT/US2019/027502.
International Search Report and Written Opinion dated Feb. 5, 2020, issued in PCT Application No. PCT/US2019/031541.
International Search Report and Written Opinion dated Jan. 16, 2020, issued in PCT Application No. PCT/US2019/027625.
International Search Report and Written Opinion dated Jan. 21, 2020, issued in PCT Application No. PCT/US2019/028508.
International Search Report and Written Opinion dated May 25, 2020, issued in PCT Application No. PCT/US2019/056206.
International Search Report and Written Opinion dated May 26, 2020, issued in PCT Application No. PCT/US2019/059757.

* cited by examiner

BUOYANCY ASSIST TOOL WITH ANNULAR CAVITY AND PISTON

The length of deviated or horizontal sections in well bores is such that it is sometimes difficult to run well casing to the desired depth due to high casing drag. Long lengths of casing create significant friction and thus problems in getting casing to the toe of the well bore. Creating a buoyant chamber in the casing utilizing air or a fluid lighter than the well bore fluid can reduce the drag making it easier to overcome the friction and run the casing to the desired final depth.

DESCRIPTION

Figure 1:
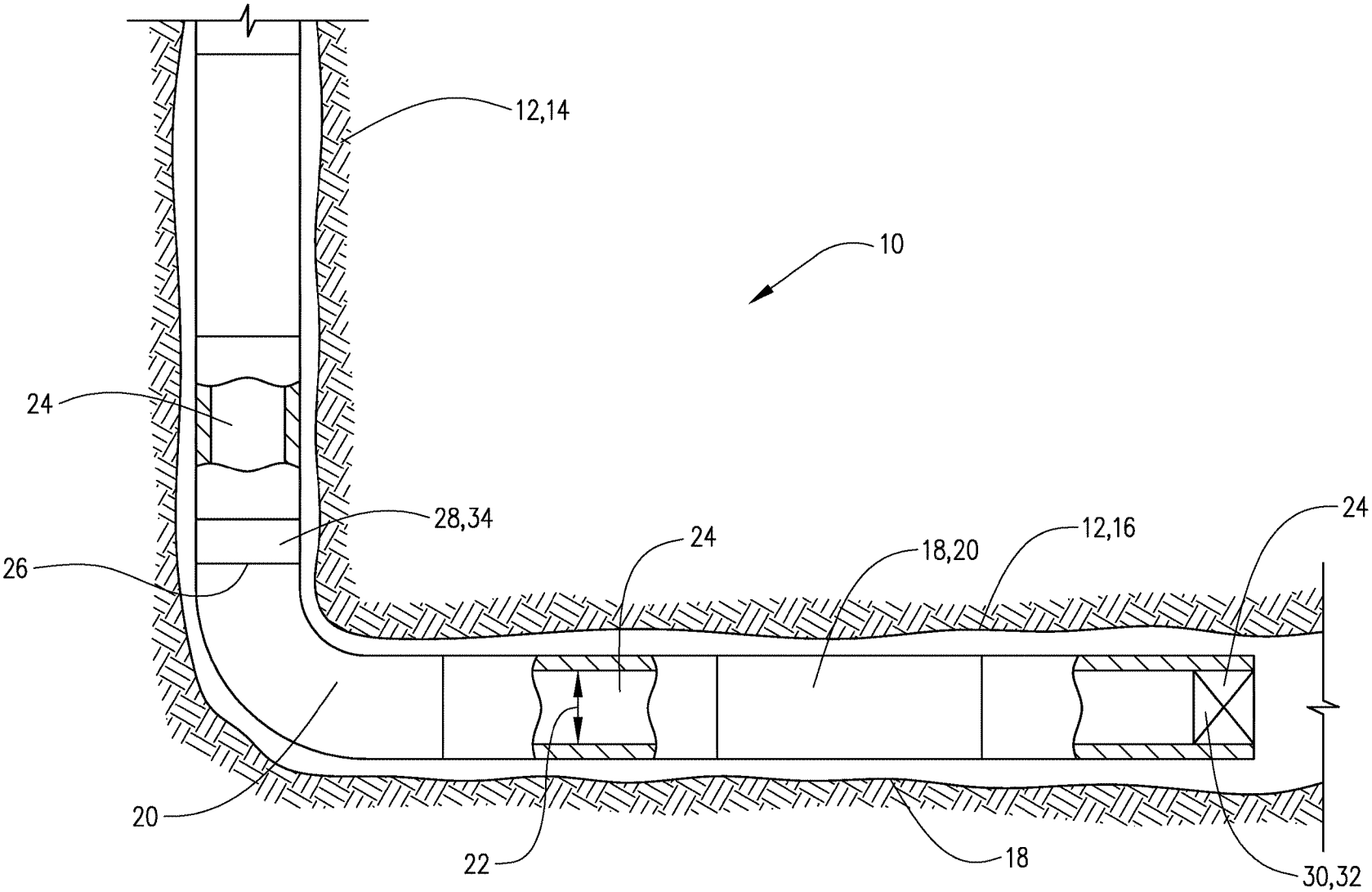
FIG. 1 is a schematic view of an exemplary well bore with a well casing including a buoyancy chamber therein.
Figure 2:
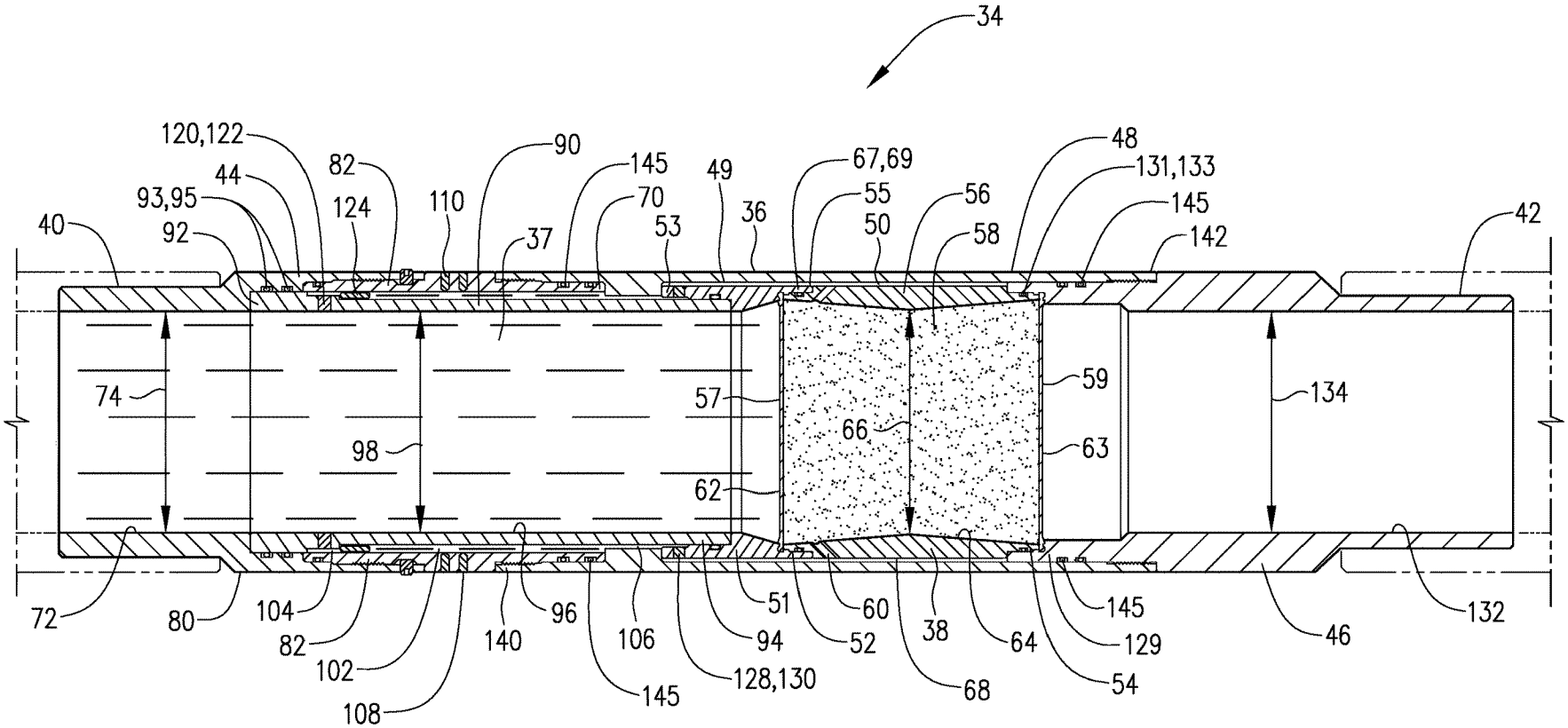
FIG. 2 is a cross section of a buoyancy assist tool of the current disclosure.
Figure 3:
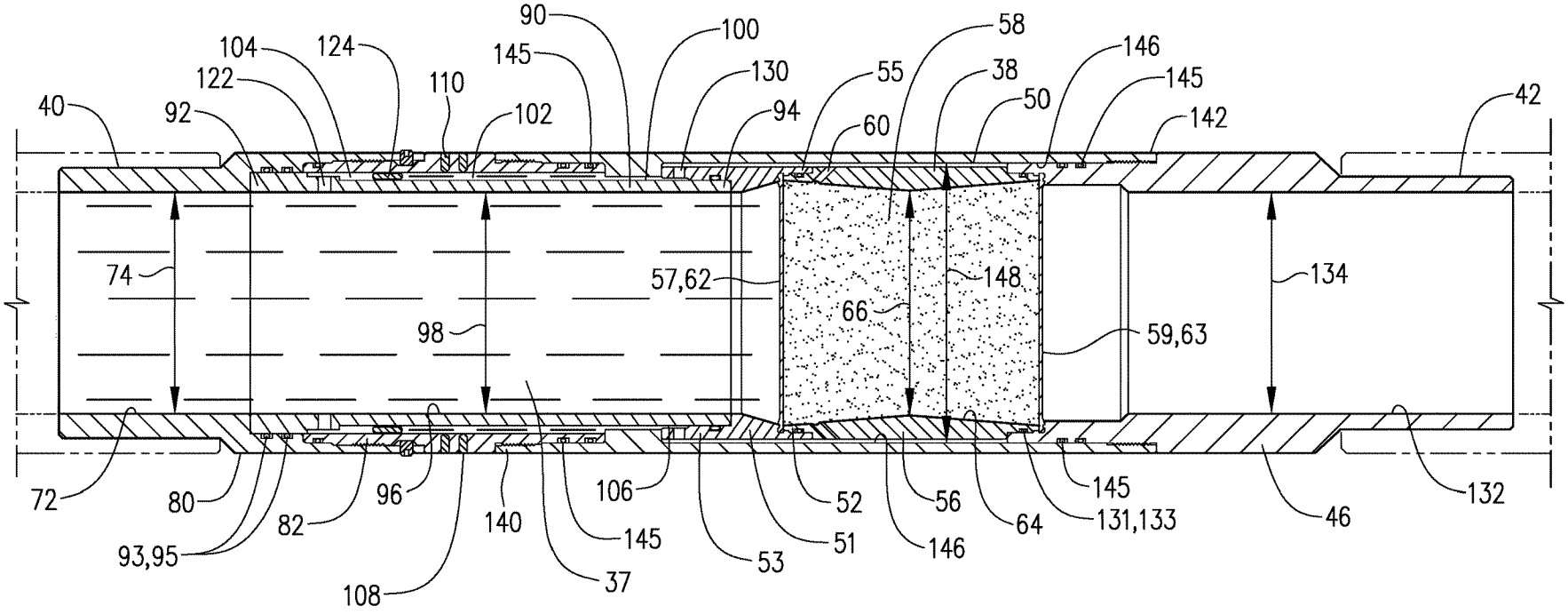
FIG. 3 is a cross section of a buoyancy assist tool of FIG. 2 after pressure has been applied to the annular piston.
Figure 4:
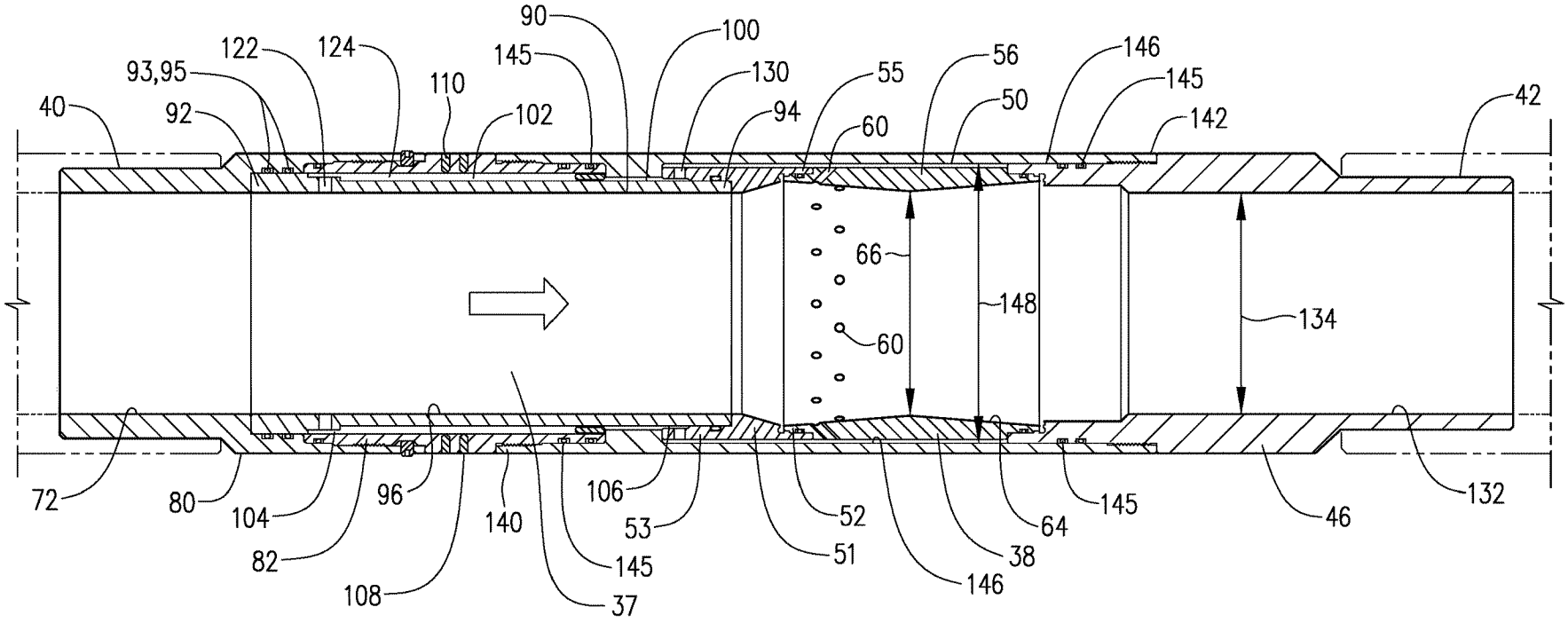
FIG. 4 is a cross section of the buoyancy assist tool of FIG. 2 after the plug has degraded and removed from the buoyancy assist tool.

The following description and directional terms such as above, below, upper, lower, uphole, downhole, etc., are used for convenience in referring to the accompanying drawings. One who is skilled in the art will recognize that such directional language refers to locations in the well, either closer or farther from the wellhead and the various embodiments of the inventions described and disclosed here may be utilized in various orientations such as inclined, deviated, horizontal and vertical.

Referring to the drawings, a downhole apparatus 10 is positioned in a well bore 12. Well bore 12 includes a vertical portion 14 and a deviated or horizontal portion 16. Apparatus 10 comprises a casing string 18 which is made up of a plurality of casing joints 20. Casing joints 20 may have inner diameter or bore 22 which defines a central flow path 24 therethrough. Well casing 18 defines a buoyancy chamber 26 with upper end or boundary 28 and lower end or boundary 30. Buoyancy chamber 26 will be filled with a buoyant fluid which may be a gas such as nitrogen, carbon dioxide, or air but other gases may also be suitable. The buoyant fluid may also be a liquid such as water or diesel fuel or other like liquid. The important aspect is that the buoyant fluid has a lower specific gravity than the well fluid in the well bore 12 in which casing 18 is run. The choice of gas or liquid, and which one of these is used is a factor of the well conditions and the amount of buoyancy desired.

Lower boundary 30 may comprise a float device such as a float shoe or float collar 32. As is known, such float devices will generally allow fluid flow downwardly therethrough but will prevent flow upwardly into the casing. The float devices are generally one-way check valves. The float device 32 is thus a fluid barrier that will be configured such that it will hold the buoyant fluid in the buoyancy chamber 26 until additional pressure is applied after the release of the buoyancy fluid from the buoyancy chamber. The upper boundary 28 is defined by a buoyancy assist tool as described herein.

Buoyancy assist tool 34 includes an outer case 36 defining flow path 37 therethrough that is connectable in casing string 18. Buoyancy assist tool 34 comprises a plug assembly 38 that is connected to and positioned in outer case 36. Buoyancy assist tool 34 has upper end 40 and lower end 42. Buoyancy assist tool 34 is connectable in the casing string at the upper and lower ends 40 and 42 thereof and forms a part of the casing string 18 lowered into well bore 12.

Outer case 36 comprises an upper outer case 44 and a lower outer case 46. A connecting shield 48 is connected to and extends between upper outer case 44 and lower outer case 46. Outer case 36 and plug assembly 38 define an annular space 50 therebetween. In the embodiment described, annular space 50 is defined by and between connecting shield 48.

Plug assembly 38 has upper end 52 and lower end 54. Plug assembly 38 is connected to plug housing extender 51 at the upper end 52 and to lower outer case 46 at the lower end 54 thereof. Plug housing extender 51 has upper end 53 and lower end 55. Plug housing extender 51 and outer case 36 define an annular space 49 therebetween, which is an extension of and forms a part of annular space 50. The plug assembly 38 may be threadedly connected or connected by other means known in the art to outer case 36 and plug housing extender 51. Plug assembly 38 may comprise a plug housing 56 with upper and lower ends 52 and 54 which are the upper and lower ends of the plug assembly 38.

A degradable plug or degradable core 58 is fixed in plug housing 56. Degradable core 58 has upper end 57 and lower end 59, which may be for example coincident with the upper and lower ends 52 and 54 of plug housing 56. The degradable core may be a matrix of sand and salt but can be other degradable substances that can be degraded with fluids or other means once the casing string 18 is lowered into the wellbore to a desired location in the well. Plug housing 56 has a plurality of plug housing ports 60 defined through the wall thereof. Plug housing ports 60 communicate the annular space 50 with the degradable plug or core 58 so that fluid passing therethrough can contact degradable plug 58 and can degrade the plug to remove it from plug housing 56 to create a full bore flow path therethrough.

Buoyancy assist tool 34 may include an upper impermeable membrane 62 positioned across upper end 57 of degradable plug 58 and a lower impermeable membrane 63 positioned across the lower end 59 of degradable plug 58. Membranes 62 and 63 will prevent fluid thereabove from contacting the degradable plug at the upper end of the plug assembly 38 prior to the time casing string 18 is placed at the desired location in wellbore 12. Likewise, the impermeable membrane 63 will prevent fluid in the buoyancy chamber 26 from contacting the degradable plug 58 until such time as degradation of the plug is desired. Upon degradation of the plug 58 the membranes 62 and 63 will be easily ruptured by fluid flowing through the casing string 18, including outer case 36. Membranes 62 and 63 may be comprised of tempered glass, rubber or other material that will shatter or tear sufficiently such that it will not clog float device 30.

Plug housing 56 has an inner surface 64 defining a diameter 66 and has an outer surface 68. In the embodiment described diameter 66 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

Upper end 40 of buoyancy assist tool 34 is likewise the upper end of upper outer case 44. Upper outer case 44 has a lower end 70. Lower end 70 sealingly engages an inner surface of connecting shield 48. Lower end 55 of plug housing extender 51 is connected to upper end 52 of plug housing 56. Outer surface 68 of plug housing 56 may have a groove 67 with an O-ring seal 69 therein to sealingly engage an inner surface of plug housing extender 51. Upper outer case 44 has inner surface 72 which defines an inner diameter 74 that is a minimum inner diameter of upper outer case 44. Inner diameter 74 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18. Upper outer case 44 may be a two-piece outer case comprising an upper portion 80 that is threadedly and sealingly connected to lower portion 82. Lower portion 82 is connected to connecting sleeve 48.

An internal sleeve 90 has upper end 92 and lower end 94. Upper end 92 is connected to upper case 44, and in particular to upper portion 80 of upper case 44. Internal sleeve 90 may be connected by threading or other known means. Internal sleeve 90 has inner surface 96 that defines an inner diameter 98, which is a minimum inner diameter of internal sleeve 90. Inner diameter 98 is such that internal sleeve 90 will not provide a greater restriction to the size of tools that can pass therethrough that does not exist as a result of the casing with which buoyancy assist tool 34 is lowered. O-rings 93 may be placed in grooves 95 in inner surface 72 of upper outer case 44 to seal against an outer surface 100 of internal sleeve 90.

Internal sleeve 90 and outer case 36 define an annular fluid reservoir 102 therebetween with upper end 104 and lower end 106. Annular fluid reservoir 102 is communicated with annular space 50 so that fluid therefrom is communicated into plug housing ports 60. The degrading fluid in annular fluid reservoir 102, which may be for example water or other degrading fluid, will contact degradable plug 58 through ports 60 and will degrade degradable plug 58 as described herein. Fill ports 108 are defined in outer case 36, and in the embodiment shown in upper outer case 44. Annular fluid reservoir 102 can be filled with the degrading fluid through fill ports 108, and closed off with fill plugs 110.

A first rupture disk or other rupturable membrane 120 is positioned in a port 122 in internal sleeve 90. First rupture disk 120 will prevent flow through port 122 until a desired or predetermined pressure is reached in casing string 18. Upon reaching the predetermined pressure the rupture disk 120 will rupture and fluid will be communicated from casing string 18 through port 122 into annular fluid reservoir 102. Fluid will pass into annular space 50 from annular fluid reservoir 102 and from annular space 50 through plug housing ports 60 and will contact degradable plug 58. The fluid passing therethrough may be referred to as a degrading fluid. The degrading fluid may be any fluid utilized to degrade the degradable plug and may be water or other degrading fluid.

A piston 124, which may be for example an annular rubber piston, is slidably and sealingly received in annular fluid reservoir 102. Upper membrane 62 prevents the fluid in outer case 36 from contacting degradable plug 58 prior to the rupturing of rupture disk 120. A second rupture disk 128 is positioned in a port 130 in plug housing extender 51. Fluid in annular fluid reservoir 102 is trapped between piston 124 and rupture disk 128. There are certain formations in which it is not desirable to pump water. In those instances oil or another fluid other than water, such as a mud based fluid, may be utilized to fracture or otherwise treat the formation. Where, for example, water is the degrading fluid, but not the treatment fluid, water will be contained in the annular fluid reservoir 102 such that upon reaching the appropriate position in the well oil, mud or other fluid may be pumped through the casing string 18 so that as described in more detail below piston 124 will be urged downwardly once rupture disk 120 is ruptured, at which time rupture disk 128 will immediately, or almost immediately rupture and allow fluid from annular fluid reservoir 102 to pass into and through annular space 50.

Once the pressure to burst the rupture disk 120 is reached rupture disk 128 will burst as a result of pressure applied resulting from the downward movement of piston 124. The pressure required to burst rupture disk 128 is less than that required to burst rupture disk 120. The degrading liquid in annular fluid reservoir 102 passes into annular space 50 and from annular space 50 through plug housing ports 60 in plug housing 56 and will contact the degradable plug 58 until it is degraded or dissolved sufficiently such that the fluid pressure above the degradable plug 58 will remove the degradable plug 58 from outer case 36.

Lower outer case 46 has upper end 129 and a lower end which is the lower end 42 of buoyancy assist tool 34. Upper end 129 of lower outer case 46 is connected to lower end 54 of plug assembly 38. Outer surface 68 of plug housing 56 may have a groove 131 with an O-ring seal 133 therein to sealingly engage lower outer case 46. Lower outer case 46 has inner surface 132 defining an inner diameter 134. Inner diameter 134 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

Connecting sleeve 48 has upper end 140 and lower end 142. Connecting sleeve 48 is connected at its upper end 140 to an outer surface of upper outer case 44 and is connected at its lower end 142 to an outer surface of lower outer case 46. O-ring seals 145 may be positioned in grooves in the outer surfaces of the upper and lower outer cases 44 and 46 respectively to sealingly engage an inner surface 146 of connecting shield 48. Inner surface 146 of connecting shield 48 defines an inner diameter 148. Annular space 49 is defined by and between plug housing extender 51 and connecting shield 48. Annular space 49 comprises a part of annular space 50. Degrading fluid is delivered through port 130 into annular space 50. Degrading fluid is communicated through plug housing ports 60 so that it will contact degradable plug 58 to dissolve or degrade the plug.

In operation casing string 18 is lowered into wellbore 12 to a desired location. Annular fluid reservoir 102 will be filled with a degrading fluid, for example water, prior to running the casing 18 into the well. Running a casing such as casing 18 in deviated wells and long horizontal wells often results in significantly increased drag forces and may cause a casing string to become stuck before reaching the desired location in the wellbore. For example, when the casing produces more drag forces than the available weight to slide the casing down the well, the casing may become stuck. If too much force is applied to the casing string 18 damage may occur. The buoyancy assist tool 34 as described herein alleviates some of the issues and at the same time provides for a full bore passageway so that other tools or objects such as, for example production packers, perforating guns and service tools may pass therethrough without obstruction after well casing 18 has reached the desired depth. When well casing 18 is lowered into wellbore 12 buoyancy chamber 26 will aid in the proper placement since it will reduce friction as the casing 18 is lowered into horizontal portion 16 to the desired location.

Once the casing string 18 has reached the desired position in the wellbore, pressure is increased and fluid pumped through the casing string 18. The pressure will be increased to a pressure sufficient to burst rupture disk 120, which is a known, predetermined pressure. Once rupture disk 120 bursts the fluid pressure in outer case 36 will act on piston 124 to urge the piston downwardly. The pressure required to burst second rupture disk 128 is less than the pressure required to burst rupture disk 120. In the described embodiment second rupture disk 128 will rupture immediately, or almost immediately after rupture disk 120 bursts, as a result of the pressure applied by the fluid in annular fluid reservoir 102. Once rupture disk 128 bursts degrading fluid from annular fluid reservoir 102 will pass through port 130 into annular space 50. Fluid will pass from annular space 50 through plug housing ports 60 and will contact the degradable plug 58. A sufficient quantity of the degrading fluid will be utilized to degrade degradable plug 58 so that it will be completely removed from plug housing 56.

Typically, once the degradation process reaches a certain level, the degradable plug 58 will break up, and at that point both of upper and lower membranes 62 and 63 will likewise be broken, and the pieces thereof along with pieces of the degradable plug will pass through casing string 18. As a result buoyancy assist tool 34 will have an open passageway, and will not present a restriction to the passage of any tool that will otherwise pass through the casing string 18.

Embodiments herein include:

Embodiment A. A downhole apparatus that includes an outer case defining a central flow passage therethrough, an internal sleeve fixed in the outer case and defining an annular fluid reservoir therebetween, the annular fluid reservoir having upper and lower ends and having a fluid contained therein, a piston slidingly received in the annular fluid reservoir at the upper end thereof, a first rupture disk configured to rupture at a first predetermined pressure in a port positioned to communicate the central flow passage with the annular fluid reservoir upon the pressure in the outer case reaching the first predetermined pressure, a plug housing connected in the outer case, the plug housing and outer case defining an annular space therebetween, a degradable plug fixed in the plug housing, the plug housing having ports therethrough to communicate fluid from the annular space to the degradable plug, a second rupture disk configured to rupture at a second predetermined pressure in a port positioned to communicate fluid from the annular fluid reservoir into the annular space between the plug housing and the outer case upon the second rupture disk rupturing. Embodiment A may have one or more of the following additional elements in any combination:

A casing connected to the outer case.

A fill port in the outer case in communication with the annular fluid reservoir.

The first predetermined pressure being greater than the second predetermined pressure.

The second rupture disk configured to rupture immediately upon the rupturing of the first rupture disk.

The first rupture disk positioned in a port in the internal sleeve and the second rupture disk positioned in a plug housing extension connecting the internal sleeve with the plug housing.

Embodiment B. A downhole apparatus that includes a casing string, an outer case connected in the casing string and defining a central flow passage therethrough, an internal sleeve connected in the outer case, the internal sleeve and outer case defining an annular fluid reservoir therebetween, a first rupture disk positioned in a port in the internal sleeve, the port communicating the central flow passage with the annular fluid reservoir, a plug housing connected in the outer case, the plug housing and outer case defining an annular space therebetween, a rupture disk positioned to prevent communication from the annular fluid reservoir to the annular space until a predetermined pressure is reached in the annular fluid reservoir, a degradable plug fixed in the plug housing, a piston in the annular fluid reservoir, the first rupture disk configured to burst at a first predetermined pressure and open the port in the internal sleeve to communicate fluid from the central flow passage into the annular fluid reservoir and urge the piston downwardly in the annular fluid reservoir. Embodiment B may have one or more of the following additional elements in any combination:

The second rupture disk configured to burst as the piston is moved downwardly.

The plug housing defining openings therein to allow degrading fluid to contact the degradable plug.

A flow barrier connected in the casing below the degradable plug, the degradable plug and flow barrier defining a buoyancy chamber.

The piston positioned at an upper end of the annular fluid reservoir.

The second rupture disk configured to burst immediately upon the rupturing of the first rupture disk.

The outer case having a fill port communicated with the annular fluid reservoir.

Embodiment C. A downhole apparatus that includes a casing, a flow barrier connected in the casing, and a buoyancy assist tool connected in the casing above the flow barrier, the buoyancy assist tool and flow barrier defining a buoyancy chamber therebetween. The buoyancy assist tool has an outer case connected at upper and lower ends in the casing, a degradable plug positioned in the outer case to block flow therethrough, an annular fluid reservoir defined between an internal sleeve in the outer case and the outer case and configured to communicate fluid to the degradable plug upon the application of a predetermined pressure thereto, and a piston sealingly received in the annular fluid reservoir and movable therein upon the application of fluid pressure in the casing. Embodiment C may have one or more of the following additional elements in any combination:

The embodiments may have one or more of the following additional elements in any combination.

A first rupture disk in a port in the internal sleeve, the annular fluid reservoir communicated with the port.

A plug housing connected in the outer case, the degradable plug fixed in the plug housing, the plug housing and outer case defining an annular space therebetween.

A second rupture disk at a lower end of the annular fluid reservoir positioned to prevent fluid communication between the annular fluid reservoir and the annular space, the second rupture disk being configured to burst as a result of the piston moving downwardly in the annular fluid reservoir.

An impermeable membrane covering an upper end of the degradable plug.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A downhole apparatus comprising:

an outer case defining a central flow passage therethrough;

an internal sleeve fixed in the outer case and defining an annular fluid reservoir therebetween, the annular fluid reservoir having upper and lower ends and having a fluid contained therein;

a piston slidingly received in the annular fluid reservoir at the upper end thereof;

a first rupture disk configured to rupture at a first predetermined pressure in a port positioned to communicate the central flow passage with the annular fluid reservoir upon the pressure in the outer case reaching the first predetermined pressure;

a plug housing connected in the outer case, the plug housing and outer case defining an annular space therebetween;

a degradable plug fixed in the plug housing, the plug housing having ports therethrough to communicate fluid from the annular space to the degradable plug; and a second rupture disk configured to rupture at a second predetermined pressure in a port positioned to communicate fluid from the annular fluid reservoir into the annular space between the plug housing and the outer case upon the second rupture disk rupturing.

2. The downhole apparatus of claim 1 further comprising:

a casing, the outer case being connected in the casing at upper and lower ends thereof; and a flow barrier connected in the casing below the degradable plug, the degradable plug and flow barrier defining a buoyancy chamber therebetween.

3. The downhole apparatus of claim 1, the outer case having a fill port in communication with the annular fluid reservoir.

4. The downhole apparatus of claim 1, the first predetermined pressure being greater than the second predetermined pressure.

5. The downhole apparatus of claim 4, the second rupture disk configured to rupture immediately upon the first disk rupturing.

6. The downhole apparatus of claim 1, the first rupture disk positioned in a port in the internal sleeve and the second rupture disk positioned in a plug housing extension connecting the internal sleeve with the plug housing.

7. The downhole apparatus of claim 6, the piston comprising a rubber piston.

8. A downhole apparatus comprising:

a casing string;

an outer case connected in the casing string and defining a central flow passage therethrough;

an internal sleeve connected in the outer case, the internal sleeve and outer case defining an annular fluid reservoir therebetween;

a first rupture disk positioned in a port in the internal sleeve, the port communicating the central flow passage with the annular fluid reservoir;

a plug housing connected in the outer case, the plug housing and outer case defining an annular space therebetween;

a second rupture disk positioned to prevent communication from the annular fluid reservoir to the annular space until a predetermined pressure is reached in the annular fluid reservoir;

a degradable plug fixed in the plug housing;

a piston in the annular fluid reservoir, the first rupture disk configured to burst at a first predetermined pressure and open the port in the internal sleeve to communicate fluid from the central flow passage into the annular fluid reservoir and urge the piston downwardly in the annular fluid reservoir.

9. The downhole apparatus of claim 8, the second rupture disk configured to burst as the piston is moved downwardly and allow fluid from the annular fluid reservoir to be communicated into the annular space.

10. The downhole apparatus of claim 9, the plug housing defining a plurality of housing ports in a wall thereof, the housing ports being communicated with the annular space so that fluid from the annular space is communicated through the housing ports to contact the degradable plug.

11. The downhole apparatus of claim 8, the piston being positioned at an upper end of the fluid in the annular fluid reservoir.

12. The downhole apparatus of claim 8, further comprising a flow barrier connected in the casing below the degradable plug, the flow barrier and degradable plug defining a buoyancy chamber therebetween.

13. The downhole apparatus of claim 12, the second rupture disk configured to burst immediately upon the rupturing of the first rupture disk.

14. The downhole tool of claim 13, the outer case having a fill port communicated with the annular fluid reservoir.

15. A downhole apparatus comprising:

a casing;

a flow barrier connected in the casing; and a buoyancy assist tool connected in the casing above the flow barrier, the buoyancy assist tool and flow barrier defining a buoyancy chamber therebetween, the buoyancy assist tool comprising:

an outer case connected at upper and lower ends in the casing;

a degradable plug positioned in the outer case to block flow therethrough;

an annular fluid reservoir defined between an internal sleeve in the outer case and the outer case and configured to communicate fluid to the degradable plug upon the application of a predetermined pressure in the annular fluid reservoir; and a piston sealingly received in the annular fluid reservoir and movable therein upon the application of fluid pressure in the casing.

16. The downhole apparatus of claim 15, further comprising a first rupture disk in a port in the internal sleeve, the annular fluid reservoir communicated with the port in the internal sleeve.

17. The downhole apparatus of claim 16, further comprising a plug housing connected in the outer case, the degradable plug fixed in the plug housing, the plug housing and outer case defining an annular space therebetween.

18. The downhole apparatus of claim 16, further comprising a second rupture disk at a lower end of the annular fluid reservoir positioned to prevent fluid communication between the annular fluid reservoir and the annular space, the second rupture disk being configured to burst as a result of the piston moving downwardly in the annular fluid reservoir.

19. The downhole apparatus of claim 16 further comprising an impermeable membrane covering an upper end of the degradable plug.

20. The downhole apparatus of claim 15, the buoyancy assist tool defining an inner diameter that is no more restrictive for the passage of downhole tools than the inner diameter of the casing in which the buoyancy assist tool is connected.

* * * * *